US006883499B2

(12) United States Patent
Hopley et al.

(10) Patent No.: US 6,883,499 B2
(45) Date of Patent: Apr. 26, 2005

(54) ADVANCE ARRANGEMENT

(75) Inventors: Daniel J Hopley, Gillingham (GB); Robert S Bond, Challock (GB); William R Burborough, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 80 days.

(21) Appl. No.: 10/251,292

(22) Filed: Sep. 20, 2002

(65) Prior Publication Data

US 2003/0056767 A1 Mar. 27, 2003

(30) Foreign Application Priority Data

Sep. 24, 2001 (GB) ..... 0122969

(51) Int. Cl.[7] ..... F02M 37/04
(52) U.S. Cl. ..... 123/502; 123/450
(58) Field of Search ..... 123/502, 501, 123/449, 450, 500

(56) References Cited

U.S. PATENT DOCUMENTS

| | | | | |
|---|---|---|---|---|
| 3,552,366 A | | 1/1971 | Kemp | |
| 4,526,154 A | * | 7/1985 | DiDomenico | 123/502 |
| 4,557,240 A | * | 12/1985 | Sakuranaka | 123/502 |
| 5,769,056 A | | 6/1998 | Geiger et al. | |
| 6,041,759 A | * | 3/2000 | Burborough | 123/501 |
| 6,363,917 B1 | | 4/2002 | Hopley | |

FOREIGN PATENT DOCUMENTS

| | | | |
|---|---|---|---|
| EP | 0303237 A2 | | 2/1989 |
| EP | 0921300 A2 | | 6/1999 |
| GB | 984745 | | 3/1965 |
| GB | 000921300 A2 | * | 6/1999 |

* cited by examiner

*Primary Examiner*—Mahmoud Gimie
(74) *Attorney, Agent, or Firm*—David P. Wood

(57) ABSTRACT

An advance arrangement for use in controlling timing of fuel delivery by a fuel pump comprises an advance piston which is moveable within a first bore and which cooperates, in use, with a cam arrangement of a fuel pump to adjust the timing of fuel delivery by the pump, a surface associated with the advance piston being exposed to fuel pressure within an advance piston control chamber. The advance arrangement also includes a servo-piston which is slidable within a further bore provided in the advance piston to control the pressure of fuel within the advance piston control chamber, a surface associated with the servo-piston being exposed to fuel pressure within a servo control chamber. A non-drift arrangement, in the form of a drilling on or in the advance piston, is provided for preventing fuel pressure variations in the advance piston control chamber which would otherwise occur due to fuel leakage into or out of the advance piston control chamber whilst the servo control piston remains in a substantially fixed position. The advance arrangement may also include a damping arrangement for damping movement of the servo-piston in a direction to retard timing which occurs as a result of movement of the advance piston in a direction to advance timing at the end of a pumping event.

21 Claims, 1 Drawing Sheet

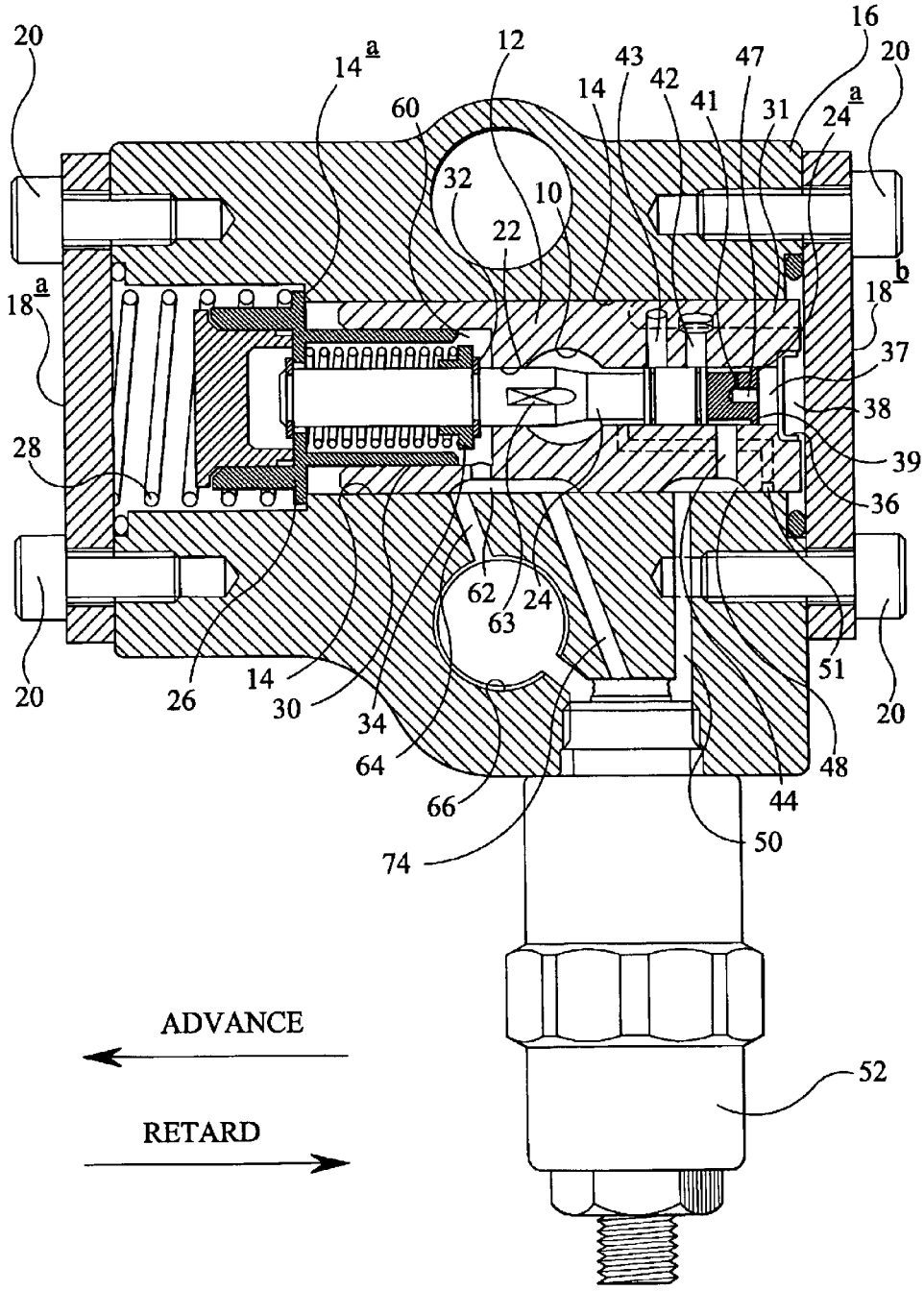
20
14a
12
43
47
16
20
14
42
41
31
24a
60
32
10
22
18a
18b
37
38
28
39
36
62
24
63
51
20
26
14
30
34
64
48
66
44
50
74
52
ADVANCE
RETARD

ADVANCE ARRANGEMENT

FIELD OF THE INVENTION

The invention relates to an advance arrangement for use in controlling the timing of fuel delivery by a high pressure fuel pump intended for use in a compression ignition internal combustion engine.

BACKGROUND OF THE INVENTION

A conventional rotary fuel pump includes a cam ring which is angularly adjustable with respect to a pump housing. The cam ring includes a plurality of cam lobes and encircles part of a distributor member which includes pumping plungers which are slidable within respective bores of the distributor member. The pumping plungers have associated respective shoe and roller arrangements, the rollers of which are engagable with the cam surface of the cam ring. In use, fuel is supplied to the bores of the distributor member by a transfer pump, a force due to fuel pressure within the bores serving to urge the plungers in a radially outward direction. The output pressure of the transfer pump (referred to as "transfer pressure") is controlled so as to be related to the speed of operation of the engine with which the pump is being used. Rotation of the distributor member relative to the cam ring causes the rollers to move relative to the cam ring, engagement between the rollers and the cam lobes thereby causing the plungers to be forced in a radially inward direction to pressurise fuel within the respective bore and causing fuel to be delivered by the pump at relatively high pressure. By altering the angular position of the cam ring by means of an advance arrangement, the timing at which fuel is delivered by the pump can be adjusted.

The advance piston is movable in response to fuel pressure changes within an advance piston control chamber. Fuel pressure within the advance piston control chamber is controlled by means of a servo-valve including a servo-piston which is movable within a further bore provided in the advance piston. The servo-piston has an associated servo control chamber to which fuel is supplied at transfer pressure, the pressure of fuel within the servo control chamber opposing a force due to a servo control spring arranged within a light load control chamber at the opposite end of the servo-piston. If the speed of rotation of the engine increases, resulting in an increase in transfer pressure, fuel pressure within the servo control chamber is increased, thereby applying a force to the servo-piston to oppose the force due to the servo spring. The servo-piston is therefore urged in a direction in which a fill passage is opened to the advance piston control chamber, permitting fuel to flow from the servo control chamber to the advance piston control chamber. As a result, fuel pressure within the advance piston control chamber is increased, increasing the volume of the advance piston control chamber, and the advance piston is caused to move in a direction to advance the timing of fuel delivery.

The pressure of fuel delivered to the servo control chamber is reduced as engine speed is decreased, under which circumstances the servo control spring serves to urge the servo-piston into a position in which a drain passage in communication with the advance piston control chamber is opened to low pressure, thereby reducing fuel pressure in the advance piston control chamber and causing the advance piston to move to a position in which the timing of fuel delivery is retarded.

The drain passage and the fill passage are defined by radially extending drillings provided in the advance piston.

The control edges of the drillings at the surface of the advance piston are spaced axially from one another by, typically, around 0.4 mm. A problem can arise if leakage of fuel into and out of the advance piston control chamber causes the advance piston to drift between a first position in which the fill passage is opened to permit fuel flow from the servo control chamber to the advance piston control chamber, and a second position in which the fill passage is closed and the drain passage is opened to permit fuel flow from the advance piston control chamber to low pressure, whilst the servo-piston remains in a fixed position. For example, if the engine timing is retarded such that the servo control piston is in a position in which the advance piston control chamber communicates with the low pressure drain through the drain passage, any fuel leakage into the advance piston control chamber may cause the advance piston to drift to a position in which the drain passage is closed by the servo-piston and the fill passage is opened. In such circumstances, the advance piston is caused to switch from a retard timing state to an advance timing state resulting in an undesirable shift in engine timing. The same problem can arise in the reverse situation if the advance piston is caused to drift from an advance timing position to a retard timing position.

It has also been observed that a problem occurs at the end of each pumping event as the rollers move over the lobes of the cam surface and the pumping plungers start their outward, return stroke within their respective plunger bores. At the point at which the rollers ride over the cam lobe, a significant force is transmitted through the cam ring and the peg to the advance piston, tending to urge the advance piston in a direction to advance timing. As a result, there is an increased fuel pressure within the light load control chamber which serves to urge the servo-piston in the opposite, retard timing direction. In such circumstances, the advance piston and the servo-piston are therefore moving almost exactly 180o out of phase with one another and, as a result, consistent and accurate control of the advance piston is difficult to achieve.

SUMMARY OF THE INVENTION

It is an object of the present invention to remove or alleviate at least one of the aforementioned problems.

According to a first aspect of the present invention there is provided an advance arrangement for use in controlling timing of fuel delivery by a fuel pump, the advance arrangement comprising;

an advance piston which is moveable within a first bore and which cooperates, in use, with a cam arrangement of a fuel pump to adjust the timing of fuel delivery by the pump, a surface associated with the advance piston being exposed to fuel pressure within an advance piston control chamber, a servo-piston which is slidable within a further bore provided in the advance piston to control the pressure of fuel within the advance piston control chamber, a surface associated with the servo-piston being exposed to fuel pressure within a servo control chamber, and means, in the form of a non-drift arrangement, for preventing fuel pressure variations in the advance piston control chamber due to fuel leakage causing the advance piston to drift whilst the servo control piston remains in a substantially fixed position.

The invention may either be provided with means for preventing fuel pressure variations within the advance piston control chamber which cause the advance piston to drift from a position in which timing is advanced to a position in which timing is retarded, or may be provided with means for preventing fuel pressure variations within the advance piston control chamber which cause the advance piston to drift from a position in which timing is retarded to a position in which timing is advanced.

Preferably, the advance piston is provided with a fill passage which is brought into communication with the servo control chamber upon movement of the servo-piston in a direction to advance timing, thereby to permit fuel within the servo control chamber to flow into the advance piston control chamber.

Preferably, the advance piston is provided with a drain passage in communication with the advance piston control chamber, the drain passage being axially spaced from the fill passage and being brought into communication with a low pressure drain upon movement of the servo-piston in a direction to retard timing.

In one preferred embodiment, the advance arrangement includes means for maintaining a negative net leakage flow into the advance piston control chamber (i.e. leakage flow out of the advance piston control chamber is in excess of a leakage flow into the advance piston control chamber), for any position of the servo-piston in which the servo control chamber communicates with the advance piston control chamber through the fill passage.

Preferably, the net negative leakage flow into the advance piston control chamber is achieved by providing means for reducing or substantially preventing leakage flow into the advance piston control chamber.

For example, the advance piston may be provided with a drilling, one end of which communicates with a low pressure drain (for example, the cam box) and the other end of which communicates with a leakage clearance. Preferably, the leakage clearance is defined between an outer surface of the advance piston and an adjacent region of the first bore, the leakage clearance providing a direct leakage flow path for fuel flow between a delivery passage to the servo control chamber and the advance piston control chamber.

The provision of the drilling in the advance piston ensures any leakage flow through the leakage flow path which would otherwise flow into the advance piston control chamber instead flows through the drilling to low pressure, thereby ensuring a net negative leakage flow into the advance piston control chamber is maintained.

Conveniently, the delivery passage to the servo control chamber is defined, at least in part, by a formation, for example a drilling or recess, provided in the advance piston.

In an alternative embodiment, the advance arrangement may include means for enhancing leakage flow out of the advance piston control chamber, thereby to ensure a net negative leakage flow into the advance piston control chamber is maintained. For example, an enhanced leakage flow out of the advance piston control chamber may be achieved by providing a flat, slot, groove or orifice in the advance piston to provide a restricted flow path for leakage fuel directly between the advance piston control chamber and the low pressure drain.

In another embodiment, the advance arrangement may be provided with means for maintaining a net positive leakage flow into the advance piston control chamber for any position of the servo-piston for which the advance piston control chamber is in communication with the low pressure drain through the drain passage.

Preferably, the advance arrangement may also include a light load piston moveable relative to the advance piston against the action of a light load control spring to adjust the timing under light load conditions.

Preferably, the advance arrangement further includes a light load control chamber for receiving fuel, the pressure of fuel within the light load control chamber being dependent upon the engine load, a surface associated with the light load piston being exposed to fuel pressure within the light load control chamber such that the position of the light load piston is dependent upon the load under which the engine operates.

In a further preferred embodiment, the servo-piston is provided with a damping arrangement for damping movement of the servo-piston in the retard timing direction which occurs as a result of movement of the advance piston in the advance timing direction at the end of a pumping event. In particular, the provision of the damping arrangement ensures that, at the end of each pumping event when the advance piston is urged in the advance timing direction by means of the reaction of plunger movement through the cam arrangement, any consequential out of phase movement of the servo control piston will be damped to improve control of the advance piston.

In a preferred embodiment, the damping arrangement may take the form of a dashpot arrangement provided at an end region of the servo-piston remote from the light load control piston, the dashpot arrangement including a restricted flow path for fuel flow which serves to limit the rate of flow of fuel out of the servo control chamber in the event that the servo control piston is urged in a direction to retard timing.

Preferably, the restricted flow path is defined by a drilling provided in the end region of the servo-piston, one end of the drilling being in communication with an annular groove on the outer surface of the servo-piston which communicates with the delivery passage and the other end being in communication with the servo control chamber.

The provision of the damping arrangement on the servo-piston ensures any out of phase movement of the advance piston and the servo-piston at the end of a pumping event when the rollers of the associated drive arrangement ride over the lobe of the cam surface, is substantially eliminated. In conventional arrangements, problems can occur under such circumstances due to simultaneous movement of the advance piston in the advance timing direction and movement of the servo-piston in the retard timing direction as a consequence of a sudden increase in fuel pressure within the light load control chamber. This can lead to loss of accurate control of the advance piston at the end of a pumping event (i.e. when the pumping plungers are at their substantially innermost positions within their respective bores).

In a still further preferred embodiment, the advance piston may include a flow path for fuel flow between the light load control chamber and the low pressure drain, the flow path being opened upon movement of the servo-piston beyond a predetermined amount, thereby to reduce fuel pressure in the light load control chamber and to permit increased acceleration of the advance piston in the advance timing direction.

Conveniently, the flow path may be defined by a flat, slot or groove on the outer surface of the servo-piston. The groove is preferably located such that communication between the light load control chamber and the low pressure drain is opened only when there is full communication between the fill passage and the annular groove on the servo-piston, and providing the servo-piston has not moved in a direction to advance timing by an amount which causes the delivery passage to be obscured by a surface of an end region of the servo-piston adjacent to the groove.

For the purpose of this specification, the phrase 'net leakage flow into the advance piston control chamber' shall be taken to mean the difference between leakage fuel flow rate into the advance piston control chamber and leakage fuel flow rate out of the advance piston control chamber through flow routes other than through the servo control chamber and the fill passage and/or the drain passage.

According to a second aspect of the present invention there is provided an advance arrangement for use in controlling timing of fuel delivery by a fuel pump, the advance arrangement comprising;

an advance piston which is moveable within a first bore and which cooperates, in use, with a cam arrangement of a fuel pump to adjust the timing of fuel delivery by the pump, a surface associated with the advance piston being exposed to fuel pressure within an advance piston control chamber, a servo-piston which is slidable within a further bore provided in the advance piston to control the pressure of fuel in the advance piston control chamber, a surface associated with the servo-piston being exposed to fuel pressure within a servo control chamber, a light load piston moveable relative to the advance piston against the action of a light load control spring by means of a force due to fuel pressure within a light load control chamber, and a damping arrangement for damping movement of the servo-piston in a direction to retard timing which occurs as a consequence of movement of the advance piston in the advance timing direction at the end of a pumping event.

It will be appreciated that preferred and/or optional features of the first aspect of the present invention may also be incorporated in the advance arrangement of the second aspect of the present invention.

The invention will further be described, by way of example only, with reference to the accompanying drawing in which there is shown a view, part in section, of a part of a fuel pump incorporating an advance arrangement in accordance with a preferred embodiment of the invention.

The advance arrangement of the present invention is suitable for use with a rotary fuel pump of the type described previously. As will be described in further detail hereinafter, the advance arrangement includes a servo-piston arrangement which is arranged to influence the degree of timing advance depending on the operating speed of the engine, and may also include a light load piston arrangement, including a load sensing piston, which is arranged to influence the degree of advance depending on the load under which the engine is operating. A temperature control valve may also be provided to influence the degree of advance depending on the operating temperature of the engine.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a diagrammatic illustration of an advanced arrangement for use in controlling timing of fuel delivery by a fuel pump, according to an embodiment of the preferred embodiment.

DETAILED DESCRIPTION OF THE PREFERRED EMBODIMENT

FIG. 1 shows an embodiment of the present invention in which the cam ring is provided with a peg (not shown) which extends into an opening 10 to the cam box provided in an advance piston 12 in order to permit adjustment of the angular position of the cam ring. The advance piston 12 is slidable within a further bore 14 provided in an advance box housing 16. The ends of the bore 14 are closed by first and second end plates 18*a*, 18*b* respectively which are secured to the advance box housing 16 by means of bolts 20.

The advance piston 12 includes an axially extending bore 22 within which a servo-piston 24 is slidable. The bore 22 is shaped to include an enlarged region within which a light load sensing piston 26 is received, the light load piston 26 including a central opening through which the servo-piston 24 extends. A light load control spring 28 is engaged between the light load piston 26 and the first end plate 18*a* to bias the light load piston 26 into engagement with a step 14*a* defined by part of the bore 14.

A servo control spring 30 is engaged between the light load piston 26 and an annular member 32 which is carried by the servo-piston 24. A shim 34 is located between the servo control spring 30 and the annular member 32. The maximum permitted movement of the servo-piston 24 relative to the light load piston 26 occurs when an end surface of the servo-piston 24 is moved into engagement with a step in the bore provided in the light load piston 26.

Movement of the servo-piston 24 relative to the advance piston 12 is limited by engagement between the annular member 32 and a part of the bore 22 provided in the advance piston 12.

At the end of the bore 22 remote from the light load piston 26, a disc-shaped member 36 is arranged within an annular groove provided in the advance piston 12. The disc-shaped member 36 defines, together with a part of the bore 22 provided in the advance piston 12, a servo control chamber 37 for receiving fuel, a force due to fuel pressure within the servo control chamber 37 acting on an end surface 24*a* of the servo-piston 24 so as to urge the servo-piston 24 towards the left in the illustration shown in FIG. 1 against the force due to the servo control spring 30. Fuel at transfer pressure is delivered to the servo control chamber 37 through a servo supply passage 50 provided in the advance box housing 16, as will be described in further detail below. For the purpose of this specification, the pressure of fuel within the servo control chamber 37 shall be referred to as "servo control pressure", the servo control pressure being dependent upon the speed at which the engine operates.

An advance piston control chamber 38 defined by an end face of the advance piston 12 remote from the light load piston 26, the associated part of the bore 14, a surface of the disc-shaped member 36 and the second end plate 18*b*. The advance piston control chamber 38 communicates, via a channel 31 formed in the outer periphery of the advance piston 12, with a radially extending fill passage 42 provided in the advance piston 12. The advance piston control chamber 38 also communicates, through the channel 31, with a drain passage 43 provided in the advance piston 12 which, depending on the position of the servo-piston 24 within the bore 22, may be able to communicate with the opening 10 to the cam box. Typically, the cam box is at relatively low pressure, commonly referred to as "cam box pressure".

At an end region of the servo-piston 24 remote from the light load piston 26, the outer periphery of the servo-piston 24 is provided with an annular groove 39 in communication with a delivery passage 44. The delivery passage 44 is defined, in part, by a radially extending drilling in the advance piston 12 and, in part, by a recess 48 provided in the outer surface of the advance piston 12, the recess 48 being located so that for all permitted positions of the advance piston 12 relative to the advance box housing 16, the recess 48 communicates with the servo supply passage 50. The end region of the servo-piston 24 is also provided with a restricted drilling 41, one end of which communicates with a part of the annular groove 39 and the other of which communicates with a further drilling 47 in communication with the servo control chamber 37. The restricted drilling 41 serves to limit the rate at which fuel can flow into and out of the servo control chamber 37.

As shown in dashed lines in the accompanying figure, the advance piston 12 is also provided with an additional drilling 51, extending from the outer periphery of the advance piston 12 to the opening 10. The additional drilling 51 provides a flow path to low pressure for fuel at transfer pressure which may leak from the recess 48 of the delivery passage 44 as fuel is supplied to the servo control chamber 37, and which would otherwise leak into the advance piston control chamber 38 through a leakage clearance defined between the outer surface of the advance piston 12 and the adjacent region of the bore 22. Any such fuel leakage into the advance piston control chamber 38 is undesirable and may cause switching of the advance piston 12 between advance and retard timing positions, therefore resulting in an undesirable change in engine timing, as will be described in further detail below.

In use, fuel is delivered to the delivery passage 44 and, hence, to the annular groove 39 from where fuel is able to flow through the drillings 41, 47 to the servo control chamber 37 at a relatively low rate. As fuel pressure within the servo control chamber 37 increases, the force acting on the end surface 24*a* of the servo-piston 24 is increased causing the servo-piston 24 to be urged to the left in the illustration shown, thereby bringing the annular groove 39 into communication with the fill passage 42 and permitting fuel to flow into the advance piston control chamber 38. Increased fuel pressure within the advance piston control chamber 38 to urge the advance piston 12 to the left in the illustration shown (an advance timing direction), increasing the volume of the advance piston control chamber 38 and advancing the timing of fuel delivery by the pump.

If fuel pressure in the servo control chamber 37 is reduced as result of a reduction in transfer pressure, the force acting on the end surface 24*a* of the servo-piston 24 is reduced and the servo-piston 24 is urged to the right in the illustration shown due to the force of the servo control spring 30. A point will be reached at which communication between the fill passage 42 and the annular groove 39 is broken by the outer surface of the servo-piston 24 and, subsequently, communication between the drain passage 43 and the opening 10 to the cam box is opened. Thus, depending on the position of the servo-piston 24 within the bore 22, the advance piston control chamber 38 communicates with the delivery passage 44 through the fill passage 42 and the annular groove 39 in the advance piston 12, or the chamber 38 communicates with the opening 10 in the advance piston 12 at cam box pressure. If the servo piston 24 is urged to a position in which the advance piston control chamber 38 communicates with the low pressure drain, the advance piston 12 is urged towards the right in the illustration shown, the volume of the advance piston control chamber 38 is decreased and the timing of fuel delivery is retarded.

The advance arrangement is also provided with a light load advance arrangement, including a light load control chamber 60, defined by the advance piston 12 and the light load piston 26, within which the servo control spring 30 is arranged. The light load control chamber 60 communicates with an additional recess 62 provided in the outer surface of the advance piston 12. The additional recess 62 is arranged such that, for all permitted positions of the advance piston 12, it communicates with a light load supply passage 64. The light load supply passage 64 communicates with a bore 66 provided in the advance box housing 16 such that fuel can be delivered to the light load control chamber 60, in use, the pressure of fuel delivered to the light load control chamber 60 being dependent upon the load under which the engine operates.

Depending on the axial position of the advance piston 12, the additional recess 62 provided on the outer surface of the advance piston 12 may communicate with a cold advance supply passage 74 defined in the advance box housing 16, an electro-magnetically operated temperature control valve 52 being mounted upon the cam box housing 16 to control the supply of fuel through the cold advance supply passage 74. Typically, the temperature control valve 52 takes the form of a conventional stop solenoid which is supplied with electrical current only when the engine is at a relatively low temperature. The temperature control valve 52 is therefore only in an open position when the engine is cold. The provision of the temperature control valve 52 provides a means of advancing the timing of fuel delivery in the event that engine temperature falls below a predetermined amount. Details of the operation of such a cold advance arrangement can be found in our co-pending European patent application EP 0921 300 A.

In use, fuel delivered through the light load supply passage 64 to the light load control chamber 60 acts on the light load piston 26 to oppose the force due to the light load control spring 28. If fuel pressure within the light load control chamber 60 is relatively low, the light load piston 26 is biased by means of the light load spring 28 into engagement with the step 14*a* defined by the bore 14. However, if fuel pressure within the light load control chamber 60 is increased sufficiently, the light load piston 26 will be urged away from the step 14*a* such that the maximum permitted level of advance is altered. Further details of the operation of the light load advance arrangement can also be found in EP 0921 300 A.

Under normal operating conditions where the engine is hot, the temperature control valve 52 is switched so that a metered flow of fuel at transfer pressure is supplied into the light load supply passage 64, but is not supplied to the cold advance supply passage 74. In such circumstances, fuel pressure within the light load control chamber 60 is relatively low and, thus, the light load piston 26 is biased by means of the light load spring 28 into engagement with the step 14*a* defined by the bore 14. Fuel at transfer pressure is also supplied through the servo supply passage 50, into the recess 48, through the delivery passage 44 into the annular groove 39 in the advance piston 12 and, hence, through the restricted drilling 41 and the further drilling 47 into the servo control chamber 37. With the servo-piston 24 in the position shown in FIG. 1, fuel delivered to the servo control chamber 37 is unable to flow through the radially extending passage 42 into the advance piston control chamber 38 and the position of the advance piston 12 within the bore 14 is not advanced.

Should the speed of rotation of the engine increase, resulting in an increase in transfer pressure, fuel pressure supplied to the servo control chamber 37 is increased. An increased force is therefore applied to the end surface 24*a* of the servo-piston 24 which serves to urge the servo-piston 24, against the action of the servo control spring 30, to a position in which communication between the servo control chamber 37 and the fill passage 42 is permitted. In such circumstances, fuel flows from the servo control chamber 37, through the further drilling 47 and the restricted drilling 41 and through the fill passage 42 into the advance piston control chamber 38. The flow of fuel to the control chamber 38 increases fuel pressure therein, thereby applying a force to the advance piston 12 which causes the advance piston 12 to move in the advance timing direction (i.e. towards the left in the orientation illustrated in FIG. 1). Movement of the advance piston 12 in the advance direction causes movement of the cam ring, due to the co-operation of the peg with the opening 10, and the timing of fuel delivery by the pump is therefore advanced.

Any fuel leakage to or from the advance piston control chamber 38 which by-passes the servo control chamber 37 will cause a change in fuel pressure within the advance piston control chamber 38, as a result of which the position of the advance piston 12 will drift and the volume of the advance piston control chamber 38 will be varied. If, for example, the servo-piston 24 is in a position in which the fill passage 42 communicates with the annular groove 39, such that the advance piston 12 is urged in a direction to advance timing, any fuel leakage out of the advance piston control chamber 38, for example between the advance piston 12 and the bore 14, will cause fuel pressure in the advance piston control chamber 38 to be reduced and may result in the advance piston 12 being moved to reduce the volume of the advance piston control chamber 38 as the advance piston 12 drifts into a position in which communication between the drain passage 43 and the opening 10 is opened. If communication between the drain passage 43 and the opening 10 is opened, the advance piston 12 will be caused to move in the retard timing direction. Thus, although the servo-piston 24 remains in a substantially fixed position, the advance piston switches between a first position in which timing is advanced and a second position in which timing is retarded. Typically, the drillings which define the drain passage 43 and the fill passage 42 have adjacent control edges at the surface of the advance piston 12 which are axially spaced by around 0.4 mm, such that any such switching of the advance piston position in this way gives rise to a change in engine timing of around 1 degree.

In order to avoid the advance piston switching problem and to maintain the advance piston 12 in a position in which the fill passage 42 communicates with the annular groove 39 when the servo-piston 24 is in a position to advance timing, it is important to ensure the force due to fuel pressure within the advance piston control chamber 38 acting on the advance piston 12 does not increase beyond an amount which is sufficient to cause the advance piston 12 to drift to a position in which the drain passage 43 is opened. A negative net leakage flow (i.e. leakage flow in−leakage flow out is a negative value) into the advance piston control chamber 38 must therefore be maintained.

The present invention achieves this by providing the advance arrangement with a "non-drift" arrangement. One way to achieve this is to substantially prevent fuel leakage into the advance piston control chamber 38 by means of the drilling 51 in the advance piston 12, as shown in the accompanying figure. Any fuel leakage from the recess 48 through the leakage flow path defined between the outer surface of the advance piston 12 and the adjacent region of the bore 14 which would otherwise flow into the advance piston control chamber 38 is collected in the drilling 51 and, hence, flows to the opening 10 and to low pressure. Fuel leakage out of the advance piston control chamber 38 occurs around the outer surface of advance piston 12 during each pumping event.

In an alternative embodiment (not shown), the drilling 51 may be removed and an alternative non-drift arrangement may be provided. The net negative leakage flow into the advance piston control chamber 38 maintained by increasing the leakage flow out of the advance piston control chamber 38, for example by providing a flat, slot or groove on the outer surface of the advance piston 12 to provide restricted communication between the advance piston control chamber 38 and the opening 10. Any increased flow out of the advance piston control chamber 38 will counteract the increase in fuel pressure due to fuel leakage into the advance piston control chamber 38 from the recess 48. It has been found, however, that this solution is less desirable than that shown in FIG. 1 as the increased leakage flow out of the advance piston control chamber 38 may cause the pumping rate to be reduced.

In a further alternative embodiment, means may be provided for ensuring the advance piston 12 does not drift from a position in which communication between the drain passage 43 and the opening 10 is closed when the servo-piston 24 is in a position to retard timing. For this purpose it is necessary to maintain a net positive leakage flow (i.e. leakage flow in−leakage flow out has a positive value) into the advance piston control chamber 38, either by increasing the leakage flow into the advance piston control chamber 38, or by decreasing the leakage flow out. One way to increase the leakage flow into the advance piston control chamber 38 is to provide a flat, slot, groove or orifice in the internal bore 22 of the advance piston 12 to maintain restricted communication between the advance piston control chamber 38 and the servo control chamber 37.

The present invention also overcomes the problem of out of phase movement of the advance piston 12 and the servo control piston 24 at the end of each pumping event when the pumping plungers are at their substantially innermost positions within their respective plunger bores. In use, at the instant at which the rollers move out of engagement with the cam lobes provided on the cam ring, a significant force is transmitted through the cam ring and the peg to the advance piston 12, tending to urge the advance piston 12 towards the left in the orientation illustrated in FIG. 1 (i.e. the advance timing direction). As a result, fuel pressure within the light load control chamber 60 is temporarily increased, imparting a force to the servo-piston 24 to urge it to the right in the illustration shown (i.e. the retard timing direction). Due to the provision of the restricted drilling 41 in the end region of the servo-piston 37, fuel within the servo control chamber 37 is only able to escape at a relatively low rate, such that movement of the servo-piston 24 in the retard timing direction is damped. The restricted drilling 41 providing communication between the servo control chamber 37 and the annular groove 39 in communication with the delivery passage 44 provides a form of dashpot arrangement for damping movement of the servo-piston 24 relative to the advance piston 12 at the end of each pumping event. Thus, out of phase movement of the advance piston 12 and the servo-piston 24 at the end of each pumping event is substantially reduced or avoided altogether.

Under transient conditions, it is possible for movement of the servo-piston 24 to be accelerated at a greater rate than that of the advance piston 12. If this happens, the servo-piston 24 may be moved so far in the advance direction that the annular groove 39 moves out of communication with the fill passage 42, thereby obscuring the supply of fuel to the advance piston control chamber 38 and, thus, hindering the advance piston response rate. In a further refinement, the servo-piston 24 may therefore be provided with a flat, slot or groove 63 on its outer surface to define a flow path for fuel flow from the light load control chamber 60 to the opening 10 to the cam box upon movement of the servo-piston 24 in the advance timing direction beyond a predetermined amount, thereby permitting fuel to be spilled from the light load control chamber 60 to cam box pressure to relieve fuel pressure therein. Reduced fuel pressure within the light load control chamber 60 reduces the force acting on the advance piston to oppose fuel pressure within the advance piston control chamber 38 and enables the advance piston 12 to accelerate at a greater rate. The groove 63 is positioned such that communication between the light load control chamber 60 and the opening 10 is only opened once the servo-piston 24 has moved a sufficient distance to fully open communication between the fill passage 42 and the annular groove 39, and providing the servo-piston 24 has not moved in the advance timing direction by an amount which causes the delivery passage 44 to be obscured by the surface of the end region of the servo-piston 24 beyond the groove 39 (i.e. to the right side of the groove in the orientation shown in the accompanying figure).

It will be appreciated that the drilling 51 in the advance piston 12 and the dashpot arrangement 39, 41, 47 on the servo-piston 24 are provided for different purposes and either one may be provided independently of the other whilst still ensuring a functional advantage is obtained.

Although the description hereinbefore is of a fuel pump of the type in which pumping plungers move in a radial direction in order to supply fuel at high pressure to an engine, it will be appreciated that the advance arrangement may be applicable to other types of high pressure fuel pump.

Obviously, many modifications and variations of the present invention are possible in light of the above teachings. The invention may be practiced otherwise than as specifically described within the scope of the appended claims.

What is claimed is:

1. An advance arrangement for use in controlling timing of fuel delivery by a fuel pump, the advance arrangement comprising;

an advance piston which is moveable within a first bore to adjust the timing of fuel delivery a surface associated with the advance piston being exposed to fuel pressure within an advance piston control chamber, a servo-piston which is slidable within a further bore provided in the advance piston to control the pressure of fuel within the advance piston control chamber, a surface associated with the servo-piston being exposed to fuel pressure within a servo control chamber, and a non-drift arrangement for preventing fuel pressure variations in the advance piston control chamber due to fuel leakage causing the advance piston to drift whilst the servo control piston remains in a substantially fixed position relative to the advance piston or the cam box housing;

wherein the advance piston is provided with a fill passage which is brought into communication with the servo control chamber upon movement of the servo-piston in a direction to advance timing, thereby to permit fuel within the servo control chamber to flow into the advance piston control chamber; and wherein the non-drift arrangement is arrange to maintain a negative net leakage flow into the advance piston control chamber for any position of the servo-piston in which the servo control chamber communicates with the advance piston control chamber through the fill passage.

2. The advance arrangement as claimed in claim 1, wherein advance piston is provided with a drain passage in communication with the advance piston control chamber, the drain passage being axially spaced from the fill passage and being brought into communication with a low pressure drain upon movement of the servo-piston in a direction to retard timing.

3. The advance arrangement as claimed in claim 2, wherein the non-drift arrangement is arranged to prevent drift of the advance piston from a position in which timing is advanced to a position in which timing is retarded.

4. The advance arrangement as claimed in claim 2, wherein the non-drift arrangement is arranged to prevent advance piston drift from a position in which timing is retarded to a position in which timing is advanced.

5. The advance arrangement as claimed in claim 4, wherein the non-drift arrangement is arrange to maintain a net positive leakage flow into the advance piston control chamber for any position of the servo-piston for which the advance piston control chamber is in communication with the low pressure drain through the drain passage.

6. The advance arrangement as claimed in claim 1, wherein the non-drift arrangement is arranged to reduce or substantially prevent leakage flow into the advance piston control chamber.

7. The advance arrangement as claimed in claim 6, wherein the advance piston is provided with a drilling, one end of which communicates with the low pressure drain and the other end of which communicates with a leakage clearance.

8. The advance arrangement as claimed in claim 7, wherein the leakage clearance is defined between an outer surface of the advance piston and an adjacent region of the first bore, the leakage clearance providing a direct leakage flow path for fuel flow between a delivery passage to the servo control chamber and the advance piston control chamber.

9. The advance arrangement as claimed in claim 8, wherein the delivery passage to the servo control chamber is defined, at least in part, by a formation provided on the surface of the advance piston.

10. The advance arrangement as claimed in claim 1, wherein the non-drift arrangement is arranged to enhance leakage flow out of the advance piston control chamber, thereby to ensure a net negative leakage flow into the advance piston control chamber is maintained.

11. The advance arrangement as claimed in claim 10, wherein the advance piston is provided with a recess, groove, flat or orifice to provide a restricted flow path for leakage fuel directly between the advance piston control chamber and the low pressure drain.

12. The advance arrangement as claimed in claim 1, including a light load piston moveable relative to the advance piston against the action of a light load control spring to adjust the timing under light load conditions.

13. The advance arrangement as claimed in claim 12, including a light load control chamber for receiving fuel, the pressure of fuel within the light load control chamber being dependent upon the engine load, a surface associated with the light load piston being exposed to fuel pressure within the light load control chamber such that the position of the light load piston is dependent upon the load under which the engine operates.

14. The advance arrangement as claimed in claim 13, wherein the advance piston includes a flow path for fuel flow between the light load control chamber and the low pressure drain, the flow path being positioned such that is it opened upon movement of the servo-piston beyond a predetermined amount, thereby to reduce fuel pressure in the light load control chamber and to permit increased acceleration of the advance piston in a direction to advance timing.

15. The advance arrangement as claimed in claim 14, wherein the flow path is defined by a flat, slot or groove on the outer surface of the servo-piston.

16. The advance arrangement as claimed in claim 1, wherein the servo-piston is provided with a damping arrangement for damping movement of the servo-piston in a direction to retard timing which occurs as a result of movement of the advance piston in a direction to advance timing at the end of a pumping event.

17. The advance arrangement as claimed in claim 16, including a dashpot arrangement provided at an end region of the servo-piston, the dashpot arrangement including a restricted flow path for fuel flow which serves to limit the rate of flow of fuel out of the servo control chamber in the event that the servo control piston is urged in a direction to retard timing.

18. The advance arrangement as claimed in claim 17, wherein the restricted flow path is defined by a drilling provided in the end region of the servo-piston, one end of the drilling being in communication with an annular groove on the outer surface of the servo-piston which communicates with a delivery passage to the servo control chamber and the other end being in communication with the servo control chamber.

19. An advance arrangement for use in controlling timing of fuel delivery, the advance arrangement comprising;

an advance piston which is moveable within a first bore to adjust the timing of fuel delivery, a surface associated with the advance piston being exposed to fuel pressure within an advance piston control chamber, a servo-piston which is slidable within a further bore provided in the advance piston to control the pressure of fuel in the advance piston control chamber, a surface associated with the servo-piston being exposed to fuel pressure within a servo control chamber, a light load piston movable relative to the advance piston against the action of a light load control spring by means a force due to fuel pressure within a light load control chamber, and a damping arrangement for damping movement of the servo-piston in a direction to retard timing which occurs as consequence of movement of the advance piston in the advance timing direction at the end of a pumping event;

wherein the advance piston is provided with a fill passage which is brought into communication with the servo control chamber upon movement of the servo-piston in a direction to advance timing, thereby to permit fuel within the servo control chamber to flow into the advance piston control chamber; and wherein the non-drift arrangement is arranged to maintain a negative net leakage flow into the advance piston control chamber for any position of the servo-piston in which the servo control chamber communicates with the advance piston control chamber through the fill passage.

20. An advance arrangement for use in controlling timing of fuel delivery by a fuel pump, the advance arrangement comprising;

an advance piston which is moveable within a first bore to adjust the timing of fuel delivery, a surface associated with the advance piston being exposed to fuel pressure within an advance piston control chamber, a servo-piston which is slidable within a further bore provided in the advance piston to control the pressure of fuel within the advance piston control chamber, a surface associated with the servo-piston being exposed to fuel pressure within a servo control chamber, a non-drift arrangement for preventing fuel pressure variations in the advance piston control chamber due to fuel leakage causing the advance piston to drift whilst the servo control piston remains in a substantially fixed position relative to the advance piston or the cam box housing; and a dashpot arrangement provided at an end region of the servo-piston, the dashpot arrangement including a restricted flow path for fuel flow which serves to limit the rate of flow of fuel out of the servo control chamber in the event that the servo control piston is urged in a direction to retard timing;

wherein the servo-piston is provided with a damping arrangement for damping movement of the servo-piston in a direction to retard timing which occurs as a result of movement of the advance piston in a direction to advance timing at the end of a pumping event.

21. The advance arrangement as claimed in claim 20, wherein the restricted flow path is defined by a drilling provided in the end region of the servo-piston, one end of the drilling being in communication with an annular groove on the outer surface of the servo-piston which communicates with a delivery passage to the servo control chamber and the other end being in communication with the servo control chamber.

* * * * *